US006884115B2

(12) United States Patent
Malloy

(10) Patent No.: US 6,884,115 B2
(45) Date of Patent: Apr. 26, 2005

(54) CONNECTOR FOR HARD-LINE COAXIAL CABLE

(75) Inventor: Allen L. Malloy, Elmira, NY (US)

(73) Assignee: Thomas & Betts International, Inc., Wilmington, DE (US)

( * ) Notice: Subject to any disclaimer, the term of this patent is extended or adjusted under 35 U.S.C. 154(b) by 89 days.

(21) Appl. No.: 10/443,604

(22) Filed: May 22, 2003

(65) Prior Publication Data

US 2003/0224657 A1 Dec. 4, 2003

Related U.S. Application Data

(60) Provisional application No. 60/384,610, filed on May 31, 2002, and provisional application No. 60/427,583, filed on Nov. 19, 2002.

(51) Int. Cl.[7] ..... H01R 9/05
(52) U.S. Cl. ..... 439/584
(58) Field of Search ..... 439/583, 584

(56) References Cited

U.S. PATENT DOCUMENTS

| | | | |
|---|---|---|---|
| 3,336,563 | A | 8/1967 | Hyslop |
| 3,474,391 | A | 10/1969 | Gartzke et al. |
| 3,541,495 | A | 11/1970 | Ellis et al. |
| 3,706,958 | A | 12/1972 | Blanchenot |
| 3,744,011 | A | 7/1973 | Blanchenot |
| 3,764,959 | A | 10/1973 | Toma et al. |
| 3,847,463 | A | 11/1974 | Hayward et al. |
| 4,346,958 | A | 8/1982 | Blanchard |
| 4,408,821 | A | 10/1983 | Forney, Jr. |
| 4,408,822 | A | 10/1983 | Nikitas |
| 4,452,503 | A | 6/1984 | Forney, Jr. |
| 4,469,390 | A | 9/1984 | LeVine et al. |
| 4,540,231 | A | 9/1985 | Forney, Jr. |
| 4,583,811 | A | 4/1986 | McMills |
| 4,596,434 | A | 6/1986 | Saba et al. |
| 4,614,390 | A | 9/1986 | Baker |
| 4,648,648 | A | 3/1987 | Shigesada et al. |
| 4,668,043 | A | 5/1987 | Saba et al. |
| 4,674,818 | A | 6/1987 | McMills et al. |
| 4,717,355 | A | 1/1988 | Mattis |
| 4,834,675 | A | 5/1989 | Samchisen |
| 4,834,676 | A | 5/1989 | Tackett |
| 4,854,893 | A | 8/1989 | Morris |
| 4,902,246 | A | 2/1990 | Samchisen |
| 4,921,447 | A | 5/1990 | Capp et al. |
| 4,952,174 | A | 8/1990 | Sucht et al. |
| 4,993,964 | A | 2/1991 | Trummer |
| 5,002,503 | A | 3/1991 | Campbell et al. |
| 5,011,432 | A | 4/1991 | Sucht et al. |
| 5,120,260 | A | 6/1992 | Jackson |
| 5,137,471 | A | 8/1992 | Verespej et al. |
| 5,194,012 | A | 3/1993 | Cairns |
| 5,195,906 | A | 3/1993 | Szegda |

(Continued)

OTHER PUBLICATIONS

Thomas & Betts Corporation cross sectional view through "K" series connector catalog No. EI500K3 which has been sold in the United States prior to Jan. 2002.

Thomas & Betts Corporation cross section view through "N" series connector catalog No. EFI500W3 which has been sold in the United States prior to Jan. 2002.

*Primary Examiner*—Gary Paumen
(74) *Attorney, Agent, or Firm*—Hoffmann & Baron, LLP

(57) ABSTRACT

The present invention is a connector for connecting a coaxial cable to a device. The coaxial cable generally has a center conductor, an outer conductor, and a cable jacket. The connector includes a first portion and a second portion that are configured to be removably connected while providing both an electrical and mechanical connection between the front nut and back nut assemblies. The connector includes a ferrule having a split tubular body with first and second portions configured to cooperate with two pairs of cooperating biasing rings so that the first pair of biasing rings radially compress the first portion about the outer conductor while the second pair of biasing rings radially compress the second portion about the cable jacket.

20 Claims, 8 Drawing Sheets

U.S. PATENT DOCUMENTS

| | | | | | |
|---|---|---|---|---|---|
| 5,232,377 | A | | 8/1993 | Leibfried, Jr. | |
| 5,284,449 | A | | 2/1994 | Vaccaro | |
| 5,295,864 | A | | 3/1994 | Birch et al. | |
| 5,342,218 | A | | 8/1994 | McMills et al. | |
| 5,352,134 | A | | 10/1994 | Jacobsen et al. | |
| 5,393,244 | A | | 2/1995 | Szegda | |
| 5,470,257 | A | | 11/1995 | Szegda | |
| 5,632,651 | A | | 5/1997 | Szegda | |
| 5,651,698 | A | | 7/1997 | Locati et al. | |
| 5,746,623 | A | | 5/1998 | Fuchs et al. | |
| 5,769,662 | A | | 6/1998 | Stabile et al. | |
| 5,800,211 | A | | 9/1998 | Stabile et al. | |
| 5,879,191 | A | | 3/1999 | Burris | |
| 5,997,350 | A | | 12/1999 | Burris et al. | |
| 6,019,636 | A | | 2/2000 | Langham | |
| 6,042,422 | A | | 3/2000 | Youtsey | |
| 6,102,738 | A | * | 8/2000 | Macek et al. | 439/584 |
| 6,309,251 | B1 | * | 10/2001 | Tang | 439/584 |
| 6,331,123 | B1 | * | 12/2001 | Rodrigues | 439/584 |
| 6,530,807 | B2 | * | 3/2003 | Rodrigues et al. | 439/578 |

* cited by examiner

22

CONNECTOR FOR HARD-LINE COAXIAL CABLE

This application claims the benefit of U.S. Provisional Application No. 60/384,610 filed on May 31, 2002 and No. 60/427,583 filed on Nov. 19, 2002, which are incorporated herein by reference.

FIELD OF THE INVENTION

The present invention relates to electrical connectors and more particularly to axially compressible connectors for hard-line or semi-rigid coaxial cables

DESCRIPTION OF PRIOR ART

Coaxial cables are commonly used in the cable television industry to carry cable TV signals to television sets in homes, businesses, and other locations. A hard-line coaxial cable may be used to carry the signals in distribution systems exterior to these locations and a flexible coaxial cable is then often used to carry the signals to the interior of these locations. Hard-line or semi-rigid coaxial cable is also used where a high degree of radio-frequency shielding is required.

The hard-line cable includes a solid wire core or inner conductor, typically of copper or copper-clad aluminum, a foam-like dielectric surrounds the core and a solid tubular outer conductor encases the dielectric. The outer conductor is usually made of copper or aluminum. The dielectric material or insulation separates the inner and outer conductors. The outer conductor is covered with a cable jacket or sheath usually made of insulative plastic to provide protection against corrosion and weathering.

One type of connector for semi-rigid coaxial cables includes threaded cable connectors. These connectors generally include two or three assemblies which are rotatably connected to provide uniform compression to the coaxial cable. See, e.g., U.S. Pat. Nos. 5,352,134 and 6,019,636.

Another type of connector for semi-rigid coaxial cables includes direct solder attachment of the connector to the outer conductor of the cable. See, for example, U.S. Pat. Nos. 4,921,447 and 5,232,377. The solder attachment provides, in part, mechanical attachment of the connector to the outer conductor. Such direct solder attachment, however, has often been a production problem because of the complex equipment required for soldering and the difficulty in operating complex equipment.

Another type of cable connector for hard-line cable employs radial compression crimping to electrically and mechanically connect parts of the connector to the cable. Typically, a sleeve within the connector is compressed by a crimping tool. The sleeve may have slots, flutes, threads and the like to assist in the mechanical connection between the sleeve and the outer conductor of the cable. See, for example, U.S. Pat. Nos. 4,408,821; 4,469,390; 5,120,260 and 6,042,422. The radial crimping, however, often does not apply compressive force evenly to the outer conductor or alternatively to outer tubular jacket of the outer connector. Such uneven compression can form channels for infiltration of moisture into the coaxial cable connection and consequently leading to the degradation of the signal carried by the cable.

Another type of cable connector for hard-line cable employs axial compression crimping to electrically and mechanically connect parts of the connector to the cable. U.S. Pat. Nos. 4,408,821 and 4,452,503 disclose a connector including a grooved tubular sleeve that radially compresses a grip ring upon axial compression of the connector. The grip ring has spline fingers that furrow into the outer conductor and longitudinal slots that interlock with the outer conductor. Such an arrangement does, however, mechanically deform the outer conductor which can lead to signal loss. Furthermore, the design does not adequately guard against moisture from entering the connector because the entire circumferential surface of the outer conductor is not necessarily engaged with the grip ring. An attempt to provide a better sealing mechanism in related application, U.S. Pat. No. 4,540,231, employed glue to provide a seal. The use of glue, however, further complicated the installation and construction of such a connector.

U.S. Pat. Nos. 4,596,434 and 4,668,043 disclose a tubular housing with interior teeth which is radially compressed by a bushing upon axial compression of the connector which forces a coupling nut onto the bushing. The teeth furrow into the outer conductor to provide a mechanical and electrical connection thereat. The bushing may also contain an o-ring which acts as a seal between the bushing and the outer conductor. Such designs, however, still require significant mechanical deformation of the outer conductor which can lead to signal loss.

U.S. Pat. No. 4,834,676 discloses a ferrule with interior barbs and a longitudinal slot. The barbs deform the outer conductor upon compression of the ferrule by a tool to axially compress the connector. This design depends upon the longitudinal slot being substantially closed after compression of the ferrule to provide a seal for the connector. Such a design, however, is not effective against moisture leakage.

U.S. Pat. No. 6,331,123 discloses a connector of that provides an environmentally sealed connector for terminating a coaxial cable. The connector is a quick connect device which closes upon axial compression of the connector. The connector is useful with hard-line or semi-rigid coaxial cables having an outer deformable cable jacket.

SUMMARY OF THE INVENTION

The present invention is a hard-line or semi-rigid coaxial cable end connector. The connector allows the cable to be terminated to a cable system termination device, box or the like. The coaxial cable generally has a center conductor, an outer conductor, and a cable jacket. The connector includes a front nut assembly and a back nut assembly that are configured to be removably connected while providing both an electrical and mechanical connection between the front nut and back nut assemblies.

The front nut assembly includes an entry body housing and a pin terminal. The entry body housing is formed of an electrically conductive material with an axial bore and a first end that is configured to be removably connected to the device. The pin terminal is formed of an electrically conductive material and is supported within the axial bore of the entry body housing substantially along an axis defined by the center conductor. The first end of the pin terminal communicates with the device and the second end is configured to form an electrical connection with the center conductor.

The back nut assembly includes a clamp nut housing and a compression subassembly, which generally includes a holder sleeve, a tubular insert, and a tubular ferrule. The clamp nut housing is formed of an electrically conductive material with an axial bore. The first end of the clamp nut housing is configured to be removably connected to the second end of the entry body housing while the second end receives the coaxial cable. The holder sleeve is formed of an electrically conductive material having an exterior surface configured to be slidingly received within the axial bore of the clamp nut housing. The interior surface of the holder sleeve has a first biasing ring located between the first end and second end and a second biasing ring located at substantially the second end. The tubular insert is formed of a dielectric material defined by an outside diameter and an inside diameter. The outside diameter is dimensioned so that the tubular insert is slidingly received by the inner surface of the outer conductor and the inside diameter is dimensioned so that the insert provides a passageway to receive the center conductor of a properly prepared cable after the cable dielectric has been substantially removed. The tubular ferrule is formed of an electrically conductive material and is split to form a gap. The inner surface of the ferrule is formed with a first portion at the first end configured to closely receive the outer conductor and a second portion at the second end configured to closely receive the cable jacket. The outer surface of the ferrule is formed with a third biasing ring located around the first portion and a fourth biasing located adjacent to the second portion.

When the clamp nut housing is connected to the entry body housing, the pin terminal electrically couples the center conductor and the entry body housing is translated along the axis of the center conductor to engage the holder sleeve to translate the holder towards the second end of the clamp nut housing. The first biasing ring engages the third biasing ring to radially compress the first portion of the ferrule about the outer conductor while the second biasing ring engages the fourth biasing ring to radially compress the second portion of the ferrule about the cable jacket.

For a better understanding of the present invention, reference is made to the following description to be taken in conjunction with the accompanying drawings and its scope will be pointed out in the appended claims.

DETAILED DESCRIPTION OF THE PREFERRED EMBODIMENT OF THE INVENTION

Figure 1:
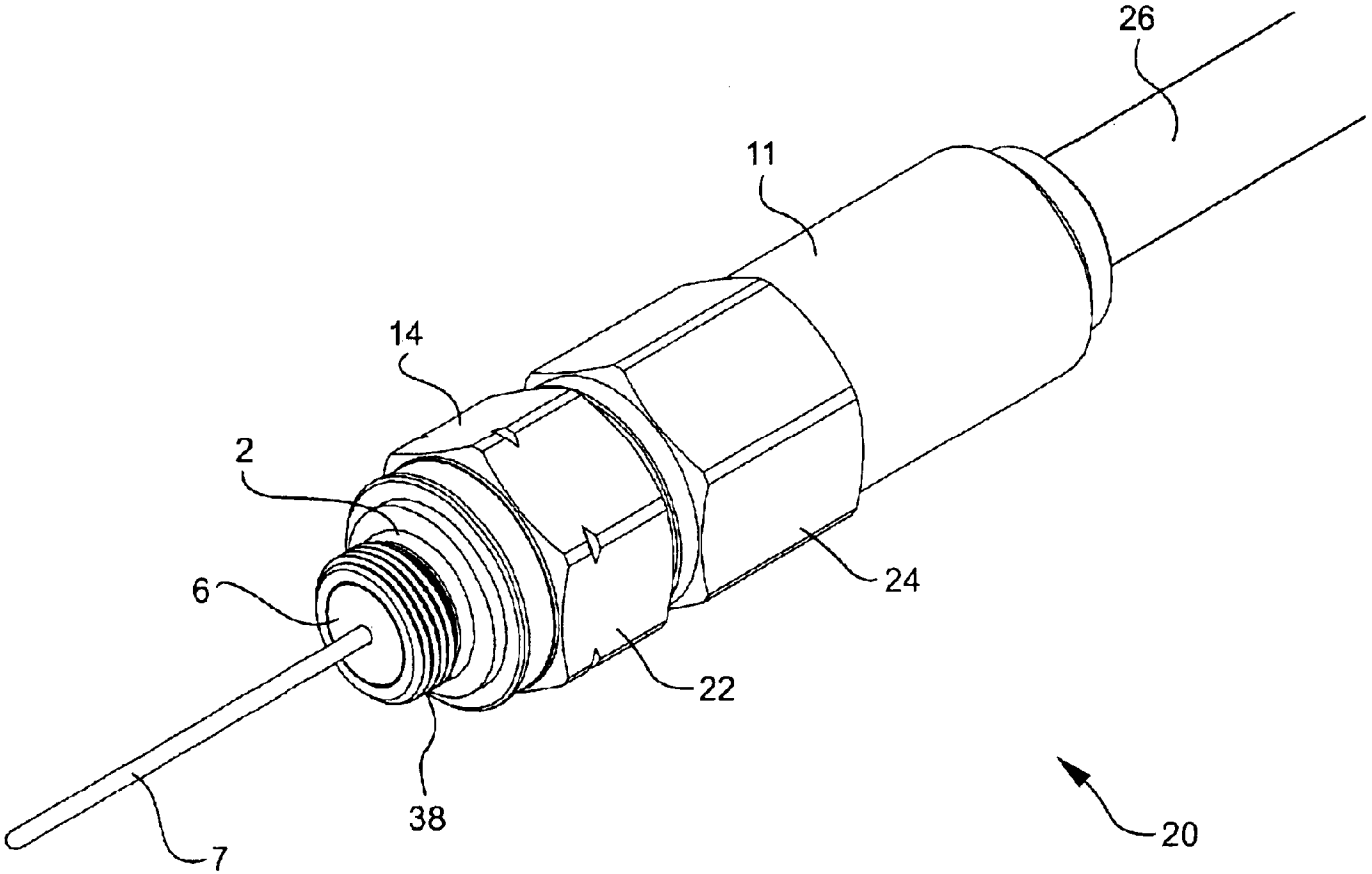
FIG. 1 is a perspective view of a first embodiment of a connector in accordance with the present invention.
Figure 2:
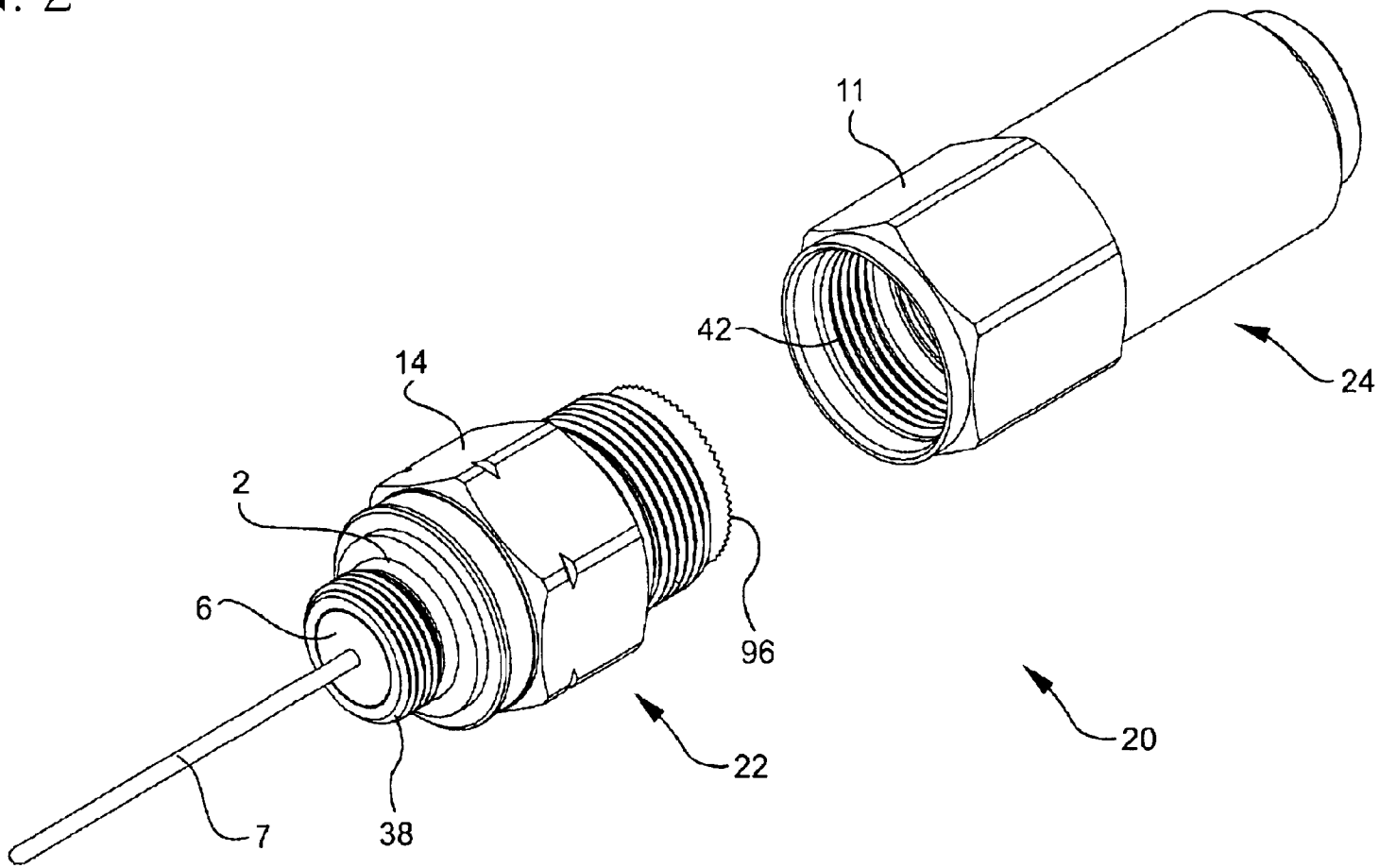
FIG. 2 is a partially exploded perspective view of the connector shown in FIG. 1 showing a front nut assembly separated from a back nut assembly.

Referring to FIGS. 1 and 2, a connector 20 in accordance with the present invention is depicted. The connector 20 is for hard-line or semi-rigid coaxial cables. The connector 20 includes a front nut assembly 22 and a back nut assembly 24 that are configured to be removably connected while providing both an electrical and mechanical connection between the front nut and back nut assemblies 22, 24.

Figure 7:
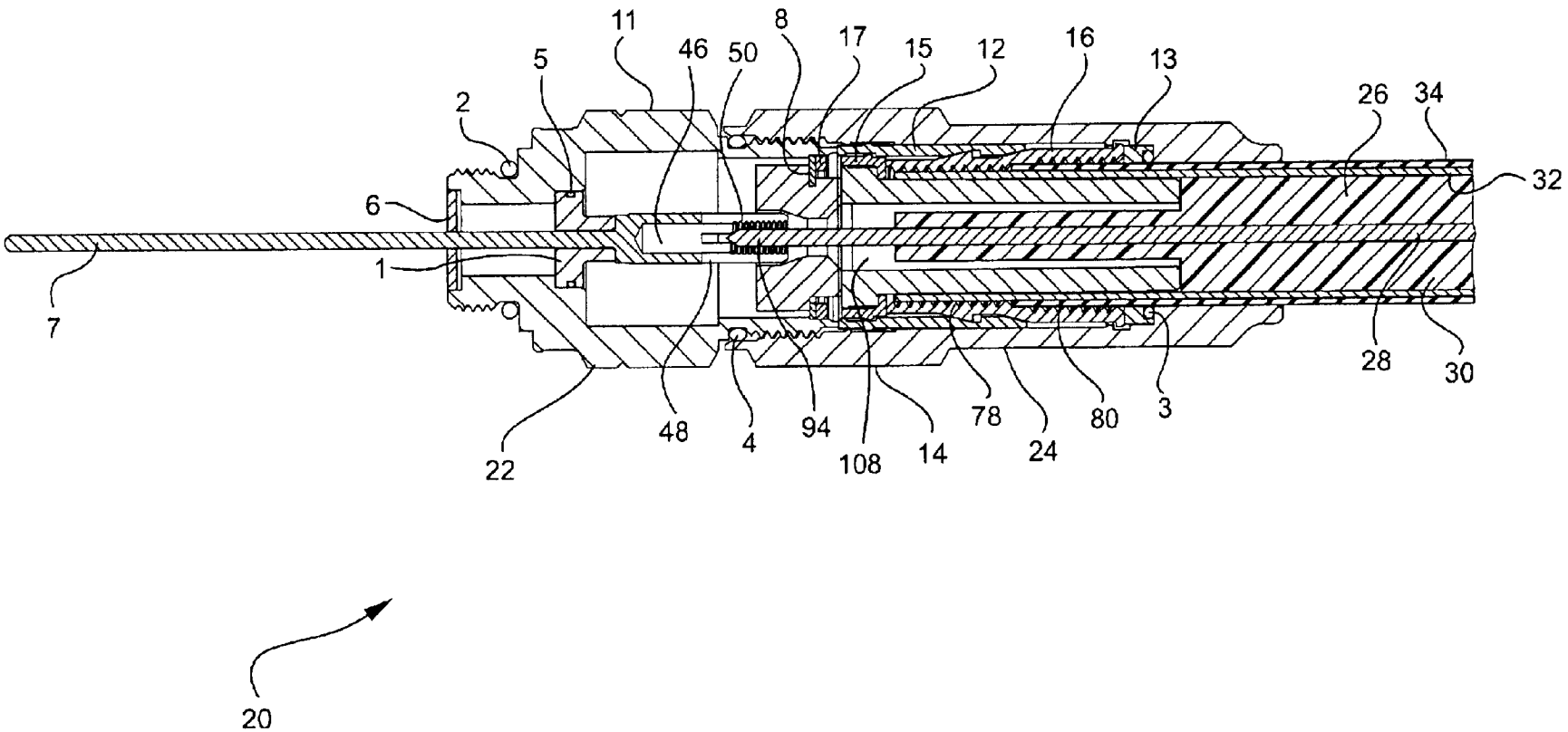
FIG. 7 is a cross-sectional view of the connector shown in FIG. 1.

Referring now to FIGS. 1 and 7, a coaxial cable 26 is inserted into the back nut assembly 24 of the connector 20. Coaxial cables 26 generally include a solid center conductor 28 capable for providing electrical signals there through. Center conductor 28 is typically formed from a conductive metal, such as copper, copper clad aluminum, copper clad steel and the like. Surrounding the cable center conductor 28 is a cable dielectric 30 which insulates the cable center conductor 28 to minimize signal loss. The cable dielectric 30 also maintains a spacing between the cable center conductor 28 and a cable outer conductor or shield 32. The cable dielectric 30 is often a plastic material, such as a polyethylene, a fluorinated plastic material, such as a polyethylene or a polytetrafluoroethylene, a fiberglass braid and the like. The cable shield or outer conductor 32 is typically made of metal, such as aluminum or steel, and is often extruded to form a hollow tubular structure with a solid wall having a smooth exterior surface. An insulative cable jacket 34 surrounds the cable outer conductor 30 to further seal the coaxial cable 26 and is typically made of plastic, such as polyvinylchloride, polyethylene, polyurethane, polytetrafluoroethylene and the like.

Referring again to FIGS. 1 through 7, the structure of the connector 20 includes a plurality of components generally having a coaxially configuration about an axis defined by the center conductor 28 of the coaxial cable 26. In describing the structure of the connector 20 and the individual components therein, the terms "first end" and "second end" refer to the left and right hand side of the connector 20 and the components thereof, respectively, as shown in FIGS. 1 through 7, and the axis of the connector refers to the axis generally defined by the center conductor 28. The left and right hand side of FIGS. 1, 2 and 7 are selected so that the front nut assembly 22 is on the left hand side and the back nut assembly 24 is on the right hand.

Figure 3:
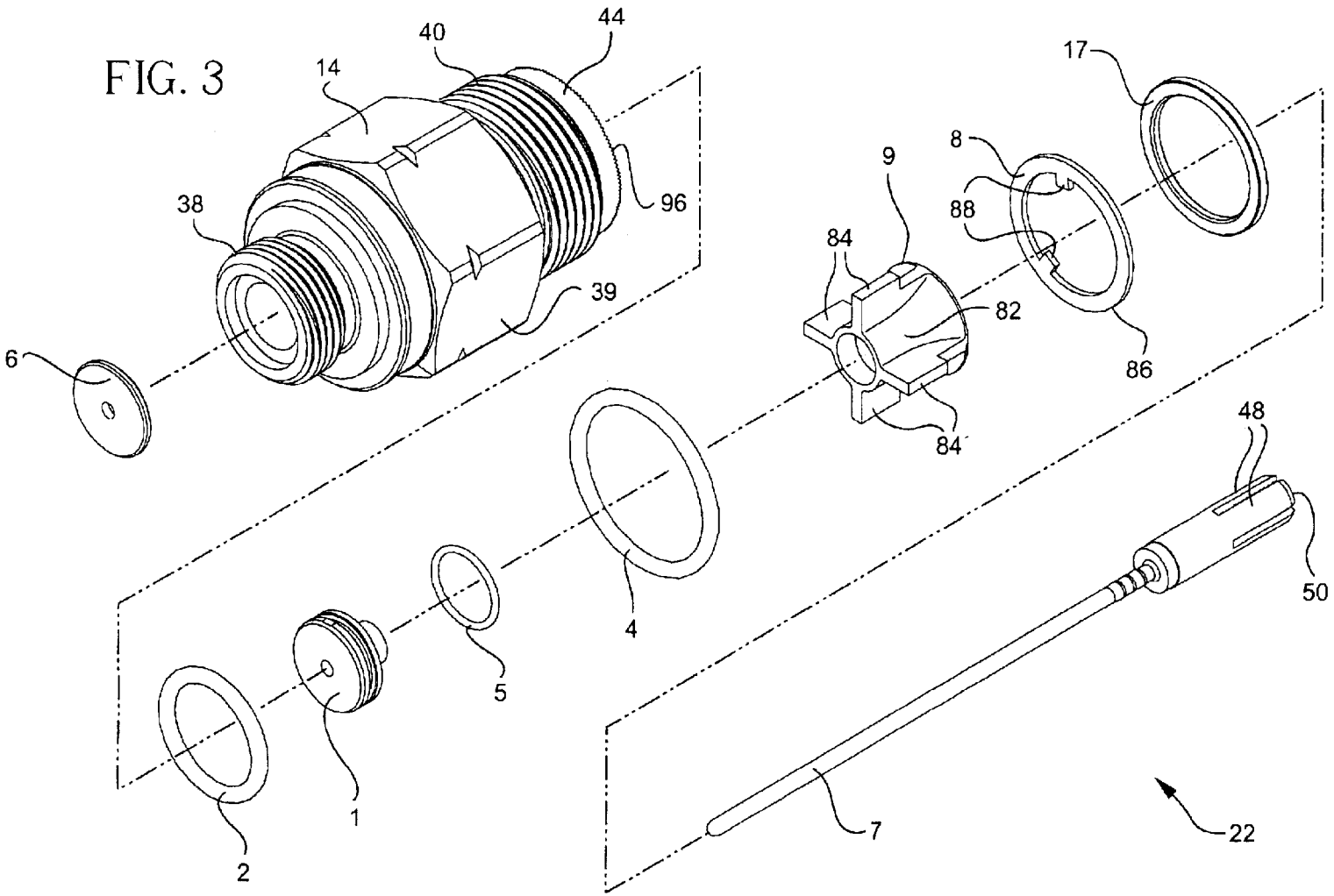
FIG. 3 is an exploded perspective view of the front nut assembly of the connector shown in FIG. 2.
Figure 5:
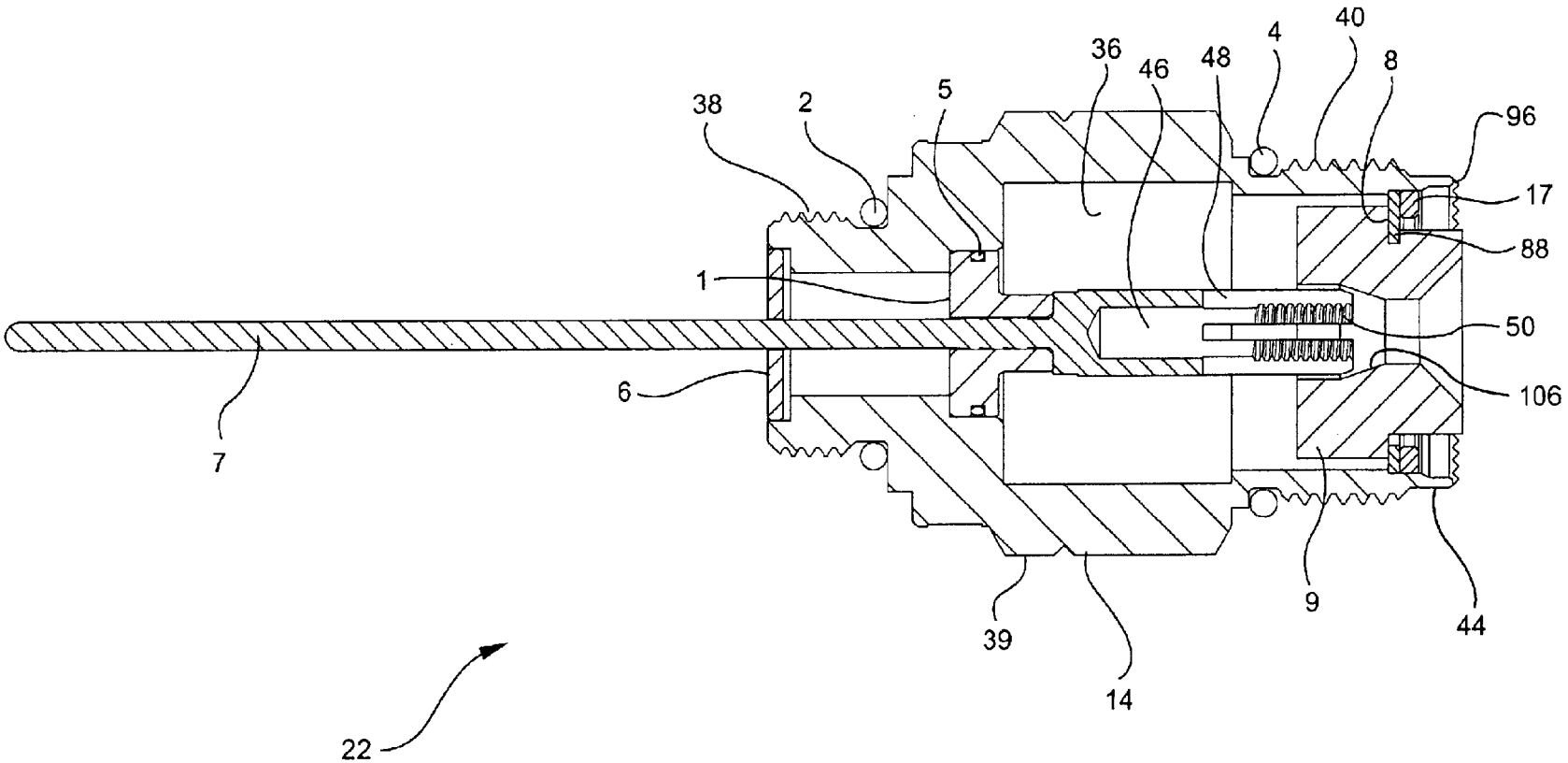
FIG. 5 is a cross-sectional view of the front nut assembly of the connector shown in FIG. 2.
Figure 8:
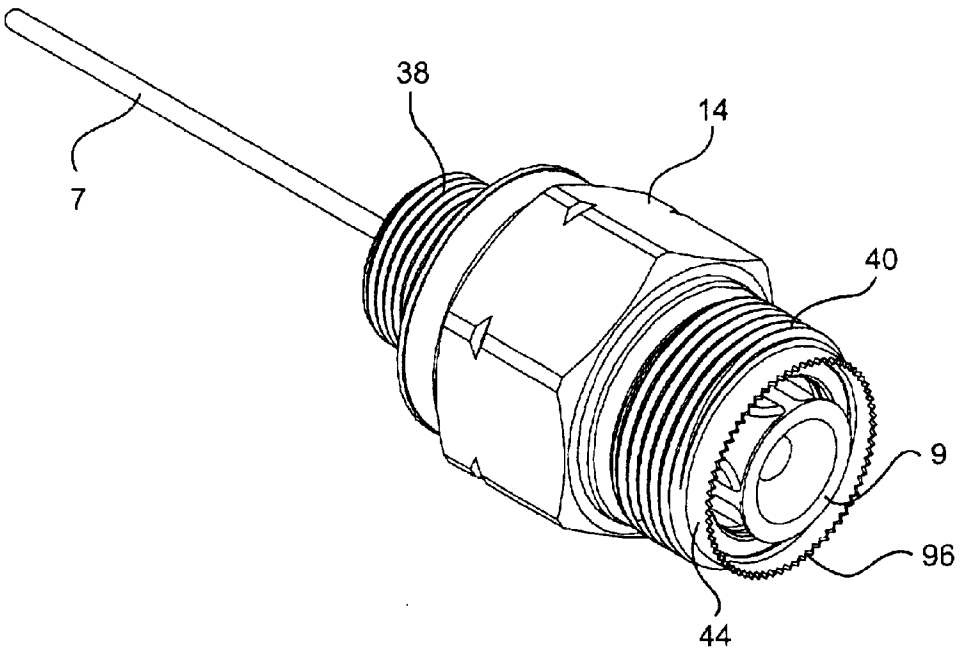
FIG. 8 is a rear perspective view of the front nut assembly showing the rim face of the entry body housing.

Referring now to FIG. 5, the front nut assembly 22 includes an entry body housing 14, a terminal support 1, and a pin terminal 7. The entry body housing 14 is formed with an axial bore 36 configured to cooperate with the terminal support 1 and is made from an electrically conductive material such as aluminum, brass or the like. The entry body housing 14 is formed with a rim 44 at its second end, and is preferably formed with a first threaded portion 38 at its first end and a second threaded portion 40 adjacent to its second end as shown in FIG. 3. The first threaded portion 38 is configured to cooperate with devices located in the field that receive the first end of the pin terminal 7. The second threaded portion 40 is configured to cooperate with a third threaded portion 42 of the back nut assembly 24 as discussed below. The entry body housing 14 is configured to support an entry body O-ring 2 at the first threaded portion 38 to improve the seal that is made with a device. A portion 39 of the exterior perimeter of the entry body housing 14 is provided with a hexagonal shape to accommodate the use of tools during installation. The rim 44 includes a rim face 96 that cooperates with the holder sleeve 12 as described below. Preferably the rim face 96 is configured to interlock with the back nut first-end face 98 of the holder sleeve 12. The rim face 96 can be formed as a radial knurl as shown in FIG. 8. Preferably the radial knurl has 32 threads per inch and is 0.01 inch deep.

The terminal support 1 is made from a dielectric material such as plastic and supports the pin terminal 7 substantially along the axis of the connector 20 as shown in FIGS. 5 and 7. A plastic that is suitable for making the terminal support is polyetherimide available from General Electric under the trade name Ultem 1000. The terminal support 1 is preferably configured to support a terminal support o-ring 5 to improve the seal between the terminal support 1 and the entry body housing 14. The pin terminal 7 is configured to form an electrical connection with the center conductor 28 as shown in FIG. 7. Preferably the diameter of the pin terminal 7 is wider at the second end when compared to the first end, and the second end is formed with a conductor bore 46 for cooperating with the center conductor 28 as shown in FIG. 7. Preferably, the pin terminal 7 is cut at least once at the conductor bore 46 along the axis of the connector 20 to form pin-terminal fingers 48 as shown in FIG. 3. The pin terminal fingers 48 are preferably formed with ridges 50 for improving the electrical connection between the pin terminal 7 and center conductor 28. The ridges 50 can be formed by making threads in the conductor bore 46. The inner diameter of the conductor bore 46 is preferably dimensioned to be larger than the diameter of the center conductor 28 of the coaxial cable 26.

Referring to FIGS. 3 and 5, the front nut assembly 22 of the connector 20 also includes a dust cap 6 and a closing collar 9. The dust cap 6 is made from a dielectric material such as plastic and is preferably located at the first end of the front nut assembly 22 to provide a seal as well as additional support to the pin terminal 7. The closing collar 9 is made from a dielectric material such as plastic, and is located at the second end of the entry body housing 14 to support the second end of the pin terminal 7 at the pin terminal fingers 48. The closing collar 9 includes a tubular body 82 and a plurality of fins 84 arranged about the exterior perimeter of the tubular body 82 so that a plane defined by each fin 84 intersects with the axis of the connector 20 as shown in FIG. 3. The first end of the tubular body 82 receives the second end of the pin terminal 7 and has an inner surface formed with a fifth ramped biasing ring 106 as shown in FIG. 5. The closing collar 9 is secured in place by an anti-twist ring 8 and a press ring 17 as shown in FIGS. 3 and 5.

Referring again to FIGS. 3 and 5, the anti-twist ring 8 includes a washer portion 86 and at least a pair of fingers 88 extending from the interior perimeter of the washer portion 86. The fingers 88 are configured to engage the side of a fin 84 to substantially prevent the closing collar 9 from rotating. The anti-twist ring 8 is preferably made from metal such as steel. The press ring 17 is preferably made from a metal such as aluminum. The press ring 17 forms a friction fit with the entry body housing 14 to secure the closing collar 9 and the anti-twist ring 8 therein.

Figure 4:
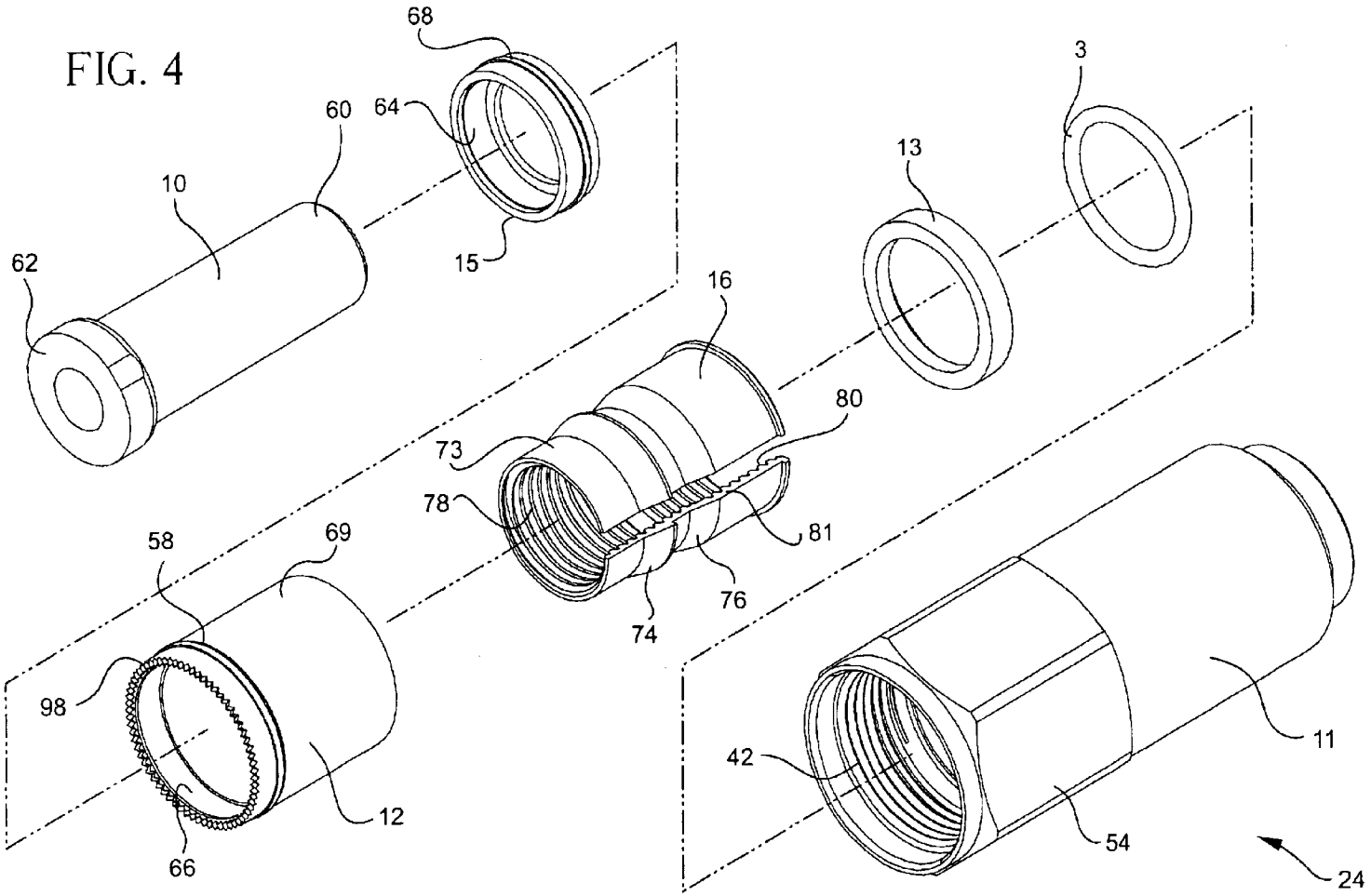
FIG. 4 is an exploded perspective view of the back nut assembly of the connector shown in FIG. 2.
Figure 6:
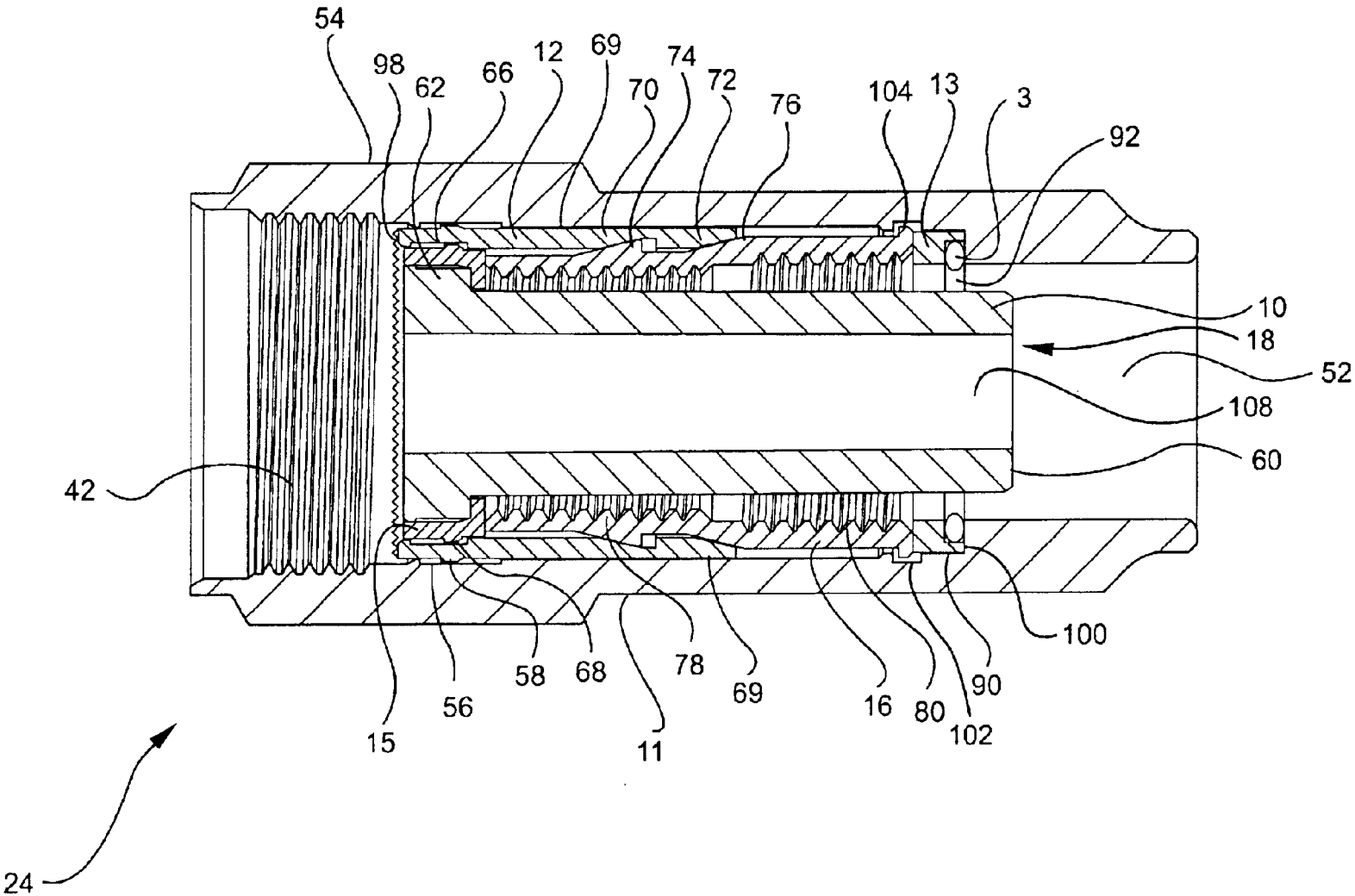
FIG. 6 is a cross-sectional view of the back nut assembly of the connector shown in FIG. 2.

Referring now to FIGS. 4 and 6, the back nut assembly 24 of the connector 20 includes a clamp nut housing 11 having an axial bore 52 and a compression subassembly 18 rotatably supported within the axial bore 52. The compression subassembly 18 generally includes an insert 10, a holder sleeve 12, and a ferrule 16 arranged in a coaxial relationship about the axis of the connector 20. Preferably the back nut assembly 24 includes a snap ring 15 for supporting the insert 10 and holding the holder sleeve 12 and the ferrule 16 within the clamp nut housing 11. The back nut assembly 24 preferably also includes a holder ring 13 and a cable jacket o-ring 3 for improving the seal between the clamp nut housing 11 and cable jacket 34. The holder ring 13 is preferably made from a metal such as brass or aluminum. The holder ring 13 is a ring 90 having an annular recess 92 formed in its second end for receiving the cable jacket o-ring 3 as shown in FIG. 6.

Referring to FIGS. 1, 2, 4, 6 and 7, the clamp nut housing 11 is formed with an axial bore 52 configured to cooperate with the holder sleeve 12, the snap ring 15, and the ferrule 16. The clamp nut housing 11 is made from an electrically conductive material such as aluminum, brass or the like. The first end of the clamp nut housing 11 is formed with the third threaded portion 42 that cooperates with the second threaded portion 40 of the entry body housing 14 so that the two connector portions may be threadedly coupled together. The diameter of the axial bore 52 at the second end of the clamp nut housing 11 is dimensioned to cooperate with the outside diameter of the cable jacket 34 as shown in FIGS. 1 and 7. The axial bore 52 is preferably formed with an annular face 100 configured to cooperate with the second end of the holder ring 13. The clamp nut housing 11 is preferably formed with a channel 56 adjacent to the third threaded portion 42 for cooperating with a ring 58 on the exterior surface of the holder sleeve 12. The clamp nut housing 11 is also preferably formed with an annular groove 102 adjacent to the first end of the holder ring 13 for cooperating with a lip 104 formed on the second end of the ferrule 16. A portion 54 of the exterior surface of the clamp nut housing 11 is provided with a hexagonal shape to accommodate the use of tools during installation as shown in FIG. 1. The clamp nut housing 11 is configured to freely rotate with respect to the holder sleeve 12, the snap ring 15, the ferrule 16, and the coaxial cable 26 prior to being connected to the entry body housing 14.

Referring to FIGS. 4, 6, and 7, the insert 10 includes a tubular body 60. The insert 10 is made from a dielectric material such as a plastic or the like. A plastic that is suitable for making the insert 10 is polyetherimide available from General Electric under the trade name Ultem 1000. The use of plastic helps to minimize signal phase problems which can occur if the cable is not properly prepared and dielectric material is not completely removed from the outer conductor and a conductive insert is used. The conductive insert provides an alternate signal path which is eliminated by the plastic insert. The outside diameter of the tubular body 60 is dimensioned to cooperate with the inner diameter of the outer conductor 32 as shown in FIGS. 6 and 7. Specifically, the inside diameter of the tubular body 60 is dimensioned to provide a passageway 108 to receive the center conductor 28 after the cable has been prepared for termination and the dielectric has been removed. Preferably, the inside diameter of the tubular body 60 is dimensioned to be larger than the diameter of the coaxial cable center conductor 28 to accommodate the possibility that remnants of the cable dielectric 30 will not be completely removed during the preparation of the cable prior to installation in the field. The insert 10 preferably includes a flange 62 located at the first end of the tubular body 60 that is configured to form a friction fit in an annular recess 64 formed in the first end of the snap ring 15. Importantly, the insert 10 is provided with a slight taper from the second end to the first end with the second end being smaller than the first end. This taper, although difficult to view from the Figures, provides the features of improved loading of the conductor into the back nut assembly 24 as well as controlling where the pleat in the outer cable conductor 32 will be located. In prior connectors, excessive pleating of the outer cable conductor 32 upon installation after tightening the two portions together makes removal and reassembly difficult. The tapered insert 10 reduces the amount of cable pleating and minimizes the need to key up or align the pleat with the gap 81 in the ferrule 16 during a second installation of the cable. Thus, the tapered insert 10 provides a distinct advantage over a non-tapered insert.

Referring now to FIGS. 4, 6, and 7, the holder sleeve 12 includes a sleeve 69 having an exterior surface configured to be received within the axial bore 52 of the clamp nut housing 11. The holder sleeve 12 includes a first ramped biasing ring 70 and a second ramped biasing ring 72 located on an interior surface for cooperating with a pair of biasing rings 74, 76 located on the outer surface of the ferrule 16. The first biasing ring 70 is preferably located between the first end and second end, and the second biasing ring is located substantially at the second end. The holder sleeve 12 is preferably made from an electrically conductive material such as aluminum or brass. The holder sleeve 12 is preferably formed with an annular channel 66 on the interior surface at the first end for cooperating with an annular key 68 on the outside surface of the snap ring 15. The holder sleeve 12 includes a face 98 at the first end that cooperates with the rim face 96 as described below. The first end face 98 is configured to interlock with the rim face 96 of the entry body housing 14. The first end face 98 is preferably formed as a radial knurl as shown in FIG. 4. In the preferred embodiment, the radial knurl has 32 threads per inch and is 0.01 inch deep.

Referring again to FIGS. 4, 6, and 7, the ferrule 16 includes a split tube 73 formed with a third ramped biasing ring 74 and a fourth ramped biasing ring 76 located on the outer surface. The inner surface includes a first portion 78 configured to make both a mechanical and electrical connection with the outer cable conductor 32 and a second portion 80 configured to engage the cable jacket 34 as shown in FIG. 7. The third biasing ring 74 is located around the first portion 78 and the fourth biasing ring 76 is preferably located adjacent to the second portion 80. The third and fourth biasing rings 74, 76 are preferably formed as conical segments. The conical segments are defined by first and second radii measured from the axis defined by the center conductor 28 at the respective first and second ends of the biasing ring 74, 76. The third and fourth biasing rings 74, 76 are configured so that the second radius is larger than the first radius. The interior diameters at both the first and second portions 78, 80 are dimensioned to allow a coaxial cable end prepared as described below to be inserted with substantially no resistance while the entry body housing 14 is not attached to the clamp nut housing 11. Preferably the inner surface is formed with a plurality of teeth at both the first and second portions 78, 80 for biting into the coaxial cable 26 to improve the connection. The plurality of teeth can be formed as an internal thread. The split tube 73 includes gap 81 to allow the diameter of the ferrule to be reduced more easily while being connected to the entry body housing 14. The ferrule 16 is made from an electrically conductive material such as aluminum or brass.

Referring now to FIGS. 2, 5, 6, and 7, the operation and installation of the connector 20 will now be described. Initially the end of the coaxial cable 26 that is to be inserted into the second end of the clamp nut housing 11 is prepared. As shown in FIG. 7, cable preparation entails removing about 0.75 inch (19.05 mm.) of cable dielectric 30, outer cable conductor 32 and cable jacket 34 to expose the portion 94 of the center conductor 28 that will engage the pin-terminal fingers 48. In addition, about 1.25 inches (31.75 mm.) of the cable dielectric 30 is removed from within the outer cable conductor 32 to provide clearance for the installation of the insert 10, and about 0.5 inch (12.70 mm.) of cable jacket 34 is removed to make an electrical connection with the first threaded portion 78 of the ferrule 16. After the cable end is prepared, it is inserted into the clamp nut housing 11 to the position shown in FIG. 7 so that the portion 94 of the center conductor 28 that engages the pin-terminal fingers 48 does not extend past the first end of the clamp nut housing 11, i.e. the center conductor 28 is substantially aligned with or below a surface of the first end of the clamp nut housing 11.

The clamp nut housing 11 is next rotated with respect to the entry body housing 14 to translate the front nut and back nut assemblies 22, 24 together along the axis of the connector 20. The clamp nut housing 11 is configured to be capable of being rotated with respect to the entry body housing 14 and coaxial cable 26 to allow the cable 26 to be installed without the need for rotating the cable 26. As the front nut and back nut assemblies 22, 24 are translated together, the portion 94 of the center conductor 28 begins to enter the bore 46 of the pin terminal 7. In addition, the rim 44 of the entry body housing 14 engages the first end 98 of the holder sleeve 12 of the compression subassembly 18 to translate the holder sleeve 12 towards the second end of the clamp nut housing 11. The interlocking mating surfaces of the rim face 96 and the first end face 98 cooperate to limit the amount of rotation between the holder sleeve 12 and entry body housing 14. The translation of the holder sleeve 12 causes the ramps of the biasing rings 70, 72 of the holder sleeve to engage the ramps of the biasing rings 74, 76 of the ferrule 16 resulting in a radial compression of the ferrule 16. The radial compression of the ferrule 16 reduces the overall diameter of the ferrule 16 and reduces gap 81 so that the first threaded portion 78 bites down on the exposed portion of the outer cable conductor 32 and the second threaded portion 80 bites down on the cable jacket 34. Further, the second end of the ferrule 16 biases the holder ring 13 and the o-ring 3 against the annular face 100 of the clamp nut housing 11 so that the o-ring seals 3 the clamp nut housing 11 with respect to the cable jacket 34. Once the o-ring 3 is compressed so that the holder ring 13 contacts the annular face 100 of the clamp nut housing 11, the holder ring 13 stops further axial translation of the ferrule 16, and the further translation of the holder sleeve 12 results in additional reduction of the gap 81 of the ferrule 16. In addition, the first end of the tubular insert 10 engages the second end of the closing collar 9 after the rim 44 engages the first end 98 to translate the closing collar 9 towards the first end of the entry body housing 14 so that the fifth ramped biasing ring 106 engages the second end of the pin terminal 7 to radially compress the pin-terminal fingers 48 about the center conductor 28 to make both an electrical and mechanical connection.

Thus, while there have been described what are presently believed to be the preferred embodiments of the invention, those skilled in the art will realize that changes and modifications may be made thereto without departing from the spirit of the invention, and is intended to claim all such changes and modifications as fall within the true scope of the invention.

What is claimed is:

1. A connector for connecting a coaxial cable to a device, the coaxial cable having a center conductor, an outer conductor, and a cable jacket, said connector comprising:

an entry body housing formed of an electrically conductive material with an axial bore therethrough, a first end of said entry body housing configured to be removably connected to the device and a second end opposite the first end;

a pin terminal formed of an electrically conductive material and being supported within said axial bore substantially along a longitudinal central axis thereof, a first end of said pin terminal communicating with the device, and a second end of said pin terminal configured to form an electrical connection with the coaxial cable center conductor;

a clamp nut housing formed of an electrically conductive material with an axial bore therethrough, a first end of said clamp nut housing configured to be removably connected to said second end of said entry body housing, and a second end of said clamp nut housing receiving the coaxial cable;

a holder sleeve formed of an electrically conductive material having a first end, a second end, an exterior surface, and an interior surface, said exterior surface configured to be slidingly received within said axial bore of said clamp nut housing, said interior surface including first and second ramped biasing rings;

a tubular insert formed of a dielectric material defined by an outside diameter and an inside diameter, said outside diameter being dimensioned so that an outer conductor of a prepared coaxial cable can slide over the outside diameter of the insert and said inside diameter is dimensioned so that said insert provides a passageway to receive the center conductor of a prepared coaxial cable; and a tubular ferrule formed of an electrically conductive material having a first end, a second end, an outer surface, and an inner surface, said tubular ferrule being split to form a gap, said inner surface being formed with a first portion at said first end configured to closely receive the outer conductor positioned over said insert and a second portion at said second end configured to closely receive the cable jacket of a prepared coaxial cable, said outer surface being formed with a third ramped biasing ring located around said first portion and a fourth ramped biasing ring located around said second portion, wherein upon connection of said clamp nut housing to said entry body housing, said second end of said pin terminal electrically couples to the center conductor and said second end of said entry body housing is longitudinally translated to engage said first end of said holder sleeve, and wherein upon coupling of the entry body housing to the clamp nut housing said first ramped biasing ring engages said third ramped biasing ring to radially compress said first portion about the outer conductor, said second ramped biasing ring engages said fourth ramped biasing ring to radially compress said second portion about the cable jacket of a prepared coaxial cable.

2. The connector as defined in claim 1, further comprising a terminal support formed of a dielectric material for supporting the pin terminal within said axial bore of said entry body housing.

3. The connector as defined in claim 1, wherein said entry body housing includes an external thread and said clamp nut housing includes a mating internal thread whereby said clamp nut housing rotates about an inserted, prepared coaxial cable upon coupling of said clamp nut housing to said entry body housing.

4. The connector as defined in claim 1, wherein said second end of said entry body housing has a rim face and said first end of said holder sleeve includes a first end face; and said rim face and said first end face are formed with cooperating interlocking surfaces to limit rotation therebetween upon connection/disconnection of said clamp nut housing and entry body housing.

5. The connector as defined in claim 4, wherein said interlocking surfaces comprise a radial knurl.

6. The connector as defined in claim 1, wherein said first portion of said ferrule is formed with a first plurality of teeth for biting the outer conductor.

7. The connector as defined in claim 6, wherein said second portion of said ferrule is formed with a second plurality of teeth for biting the cable jacket.

8. The connector as defined in claim 6, wherein said first and second plurality of teeth comprise an internal thread.

9. The connector as defined in claim 1, wherein said third ramped biasing ring comprises a conical segment defined by a first radius at said first end of said third ramped biasing ring and a second radius at said second end of said third ramped biasing ring which is larger than said first radius.

10. The connector as defined in claim 9, wherein said fourth ramped biasing ring comprises a conical segment defined by a first radius at said first end of said fourth ramped biasing ring and a second radius at said second end of said fourth ramped biasing ring which is larger than said first radius.

11. The connector as defined in claim 1, further comprising:

a snap ring including a first end formed with an annular recess and an outside surface having an annular key;

wherein said tubular insert includes a flange at said first end that is received by said annular recess of said snap ring; and said holder sleeve includes an annular channel which cooperates with said annular key.

12. The connector as defined in claim 1, further comprising:

a holder ring having an inside diameter dimensioned to slidingly receive the cable jacket, a first end of said holder ring being adjacent to said second end of said tubular ferrule, a second end of said holder ring being formed with an annular recess about said inside diameter and adjacent to said annular face of said clamp nut housing; and an o-ring located within said annular recess of said holder ring, wherein upon connection of said clamp nut housing to said entry body housing, said second end of said ferrule biases said holder ring and said o-ring against said annular face of said clamp nut housing so that said o-ring seals said clamp nut housing with respect to the cable jacket.

13. The connector as defined in claim 1, further comprising:

a closing collar formed of a dielectric material having a tubular body having an inner surface formed with a fifth ramped biasing ring, a first end of said closing collar receiving said second end of said pin terminal and a second end opposite the first end;

wherein said second end of said pin terminal includes a conductor bore for receiving the center conductor, said conductor bore being defined by a plurality of pin-terminal fingers and having a diameter which is larger than the diameter of the center conductor, wherein upon connection of said clamp nut housing to said entry body housing, said first end of said tubular insert engages said second end of said closing collar so that said fifth ramped biasing ring engages said second end of said pin terminal to radially compress said pin-terminal fingers about the center conductor.

14. The connector as defined in claim 1, wherein said first ramped biasing ring is located between said first end and second end of said holder sleeve; and said second biasing ring is located substantially at said second end of said holder sleeve.

15. A connector for connecting a coaxial cable to a device, the coaxial cable having a center conductor, an outer conductor, and a cable jacket, said connector comprising:

a front nut assembly comprising:

an entry body housing formed of an electrically conductive material with an axial bore therethrough, a first end of said entry body housing configured to be removably connected to the device and a second end of said entry body housing having a rim face; and a pin terminal formed of an electrically conductive material and being supported within said axial bore substantially along a longitudinal central axis thereof, a first end of said pin terminal communicating with the device, and a second end of said pin terminal configured to form an electrical connection with the center conductor of a prepared coaxial cable;

a backnut assembly comprising:

a clamp nut housing formed of an electrically conductive material including an axial bore therethrough, a first end of said clamp nut housing configured to be removably connected to said second end of said entry body housing, and a second end of said clamp nut housing receiving a prepared coaxial cable; and a compression subassembly having an end face and being rotatably supported within said axial bore of said clamp nut housing for forming both an electrical and mechanical connection to the outer conductor of a prepared coaxial cable; and wherein said rim face and said end face of the compression subassembly are formed with cooperating interlocking surfaces to limit rotation between said entry body housing, said compression subassembly, and the prepared coaxial cable while rotating said clamp nut housing relative to said entry body housing to connect said front nut assembly to said back nut assembly.

16. The connector as defined in claim 15, further comprising a terminal support formed of a dielectric material for supporting the pin terminal within said axial bore of said entry body housing.

17. The connector as defined in claim 16, wherein said interlocking surfaces comprise a radial knurl.

18. A coaxial cable connector comprising:

a front nut assembly including:

an entry body housing formed of an electrically conductive material having an axial bore therethrough, a first end configured to removably terminate a coaxial cable in said connector to a device, and a second end opposite said first end; and a pin terminal formed of an electrically conductive material and being supported within said axial bore substantially along a longitudinal central axis thereof, a first end of said pin terminal communicating with the device, and a second end of said pin terminal configured to form an electrical connection with the center conductor of a prepared coaxial cable inserted into said connector;

a backnut assembly including:

a clamp nut housing formed of an electrically conductive material including an axial bore therethrough, a first end of said clamp nut housing configured to be removably connected to said second end of said entry body housing, and a second end of said clamp nut housing receiving a prepared to coaxial cable; and a compression subassembly having a tubular insert and being rotatably supported within said axial bore of said clamp nut housing for forming both an electrical and mechanical connection to the outer conductor of a prepared coaxial cable, said tubular being formed of a dielectric material and tapered from a first end to a second end whereby an outside diameter of said insert is smaller at said second end than said first end, the outside diameter of said tubular insert being dimensioned to slidingly receive the outer conductor of a prepared coaxial cable, said inside diameter of the tubular insert dimensioned to provide a passageway to receive the center conductor of a prepared coaxial cable removed; and wherein said tapered tubular insert of said compression subassembly directs formation of a pleat in the coaxial cable outer conductor towards said second end of said clamp nut housing when the front nut assembly and backnut assembly are connected together.

19. The connector as defined in claim 18, further comprising a terminal support formed of a dielectric material for supporting the pin terminal within said axial bore of said entry body housing.

20. The connector as defined in claim 18, wherein said second end of said entry body housing has a rim face and said compression subassembly has an end face; and said rim face and said end face are formed with cooperating interlocking surfaces to limit rotation between said entry body housing, said compression subassembly, and the prepared coaxial cable while rotating said clamp nut housing relative to said entry body housing to connect said front nut assembly to said back nut assembly.

* * * * *